United States Patent [19]

Schulte

[11] Patent Number: 4,944,685

[45] Date of Patent: Jul. 31, 1990

[54] CONNECTOR PROTECTOR

[76] Inventor: Peter G. Schulte, 700 NE. Court, Ft. Lauderdale, Fla. 33334

[21] Appl. No.: 430,635

[22] Filed: Nov. 2, 1989

[51] Int. Cl.[5] ..... H01R 13/44

[52] U.S. Cl. ..... 439/135; 439/142; 439/367; 439/892

[58] Field of Search ..... 439/135, 142, 367, 369, 439/892

[56] References Cited

U.S. PATENT DOCUMENTS

| | | | |
|---|---|---|---|
| 3,499,102 | 3/1970 | Gillemot et al. | 439/135 |
| 4,586,765 | 5/1986 | Ban | 439/142 |
| 4,592,607 | 6/1986 | Pejovic | 439/142 |
| 4,673,230 | 6/1987 | Baumgart | 439/135 |
| 4,690,476 | 9/1987 | Morgenrath | 439/369 |
| 4,784,612 | 11/1988 | Ryan | 439/367 |
| 4,869,683 | 9/1989 | Nelson | 439/892 |

*Primary Examiner*—P. Austi Bradley

*Attorney, Agent, or Firm*—MacDonald J. Wiggins

[57] ABSTRACT

A protector for cable connectors has a double walled sleeve of flexible fabric material. Soft padding material is disposed within the double walls of the sleeve. Each open end of the sleeve includes strips of opposing hook and loop fastening material. In use, the sleeve is inserted over a connector and cable. When the connector is connected to its mating connector, the sleeve has its ends closed around the cable adjacent the connector. When the connector is disconnected, the sleeve is opened and moved to enclose the connector. The open end is closed and the other end closed around the cable.

6 Claims, 1 Drawing Sheet

CONNECTOR PROTECTOR

FIELD OF THE INVENTION

The present invention relates to protectors for electrical cable plugs and the like, and more particularly to a protector for covering a cable connector when removed from its mating connector.

DESCRIPTION OF THE PRIOR ART

The use of computer systems, peripherals, and similar electronic devices has grown greatly in the past decade. Such devices utilize a large number of interconnecting cables having connectors which are attached to matching connectors on the equipments. During maintenance or repair operations, and when equipment must be relocated, cable connectors are disconnected temporarily and generally permitted to drop to the floor. Thus, there is a chance that a connector may become damaged before being reconnected. Male connectors, card-edge connectors, ribbon cable connectors, and any unshielded connector having a plastic body or shell can be accidentally cracked, broken or otherwise damaged. Many large connectors used in diagnostic testing of computers, robotics, and the like are encased in metal and may be very heavy. When dropped on concrete floors, the cases are often bent, and pins damaged.

The prior art discloses housings or coverings for in-line connectors. Colbert, U.S. Pat. No. 3,571,782 discloses a cover for a pair of connectors having a two-part plastic sleeve. Gillemont et al., in U.S. Pat. No. 3,499,102, teach a cup shaped housing for a connection which includes Velcro® type pads for attaching the connection to stands or the like. Neither of these patents solve the problem of protecting connectors when disconnected.

SUMMARY OF THE INVENTION

The present invention provides a padded protector for temporarily enclosing a connector at the end of a cable when the connector is disconnected from its mating connector. The protector includes means for captivating it on the cable when the connector is plugged into its mating connector.

The protector of the invention has a sleeve formed from a suitable material, such as cloth, sheet plastic, or other flexible material. The sleeve may have a double thickness of material with a soft padding material inserted between the inner and outer surfaces thereof. Closures are provided along the two open ends of the sleeve. For example, narrow strips of hook and loop fastening material may be attached along the inner edges of each end. However, snaps, buttons, or other known closure devices may be used.

In use, the connector and cable is inserted through the protector sleeve and attached to its mating connector. The protector sleeve is moved to an appropriate point along the cable, and the sleeve end fasteners closed together to captivate the protector at the selected point. When it becomes necessary to remove the connector from its mating connector, the closures are opened and the protector sleeve moved to completely enclose the connector. The outer end of the protector sleeve is completely closed and the inner end closed over the cable. As will be recognized, the connector is completely protected from damage in handling, and may quickly reconnected when required.

The cover material of the connector may be made of electrically conductive material to provide electrostatic shielding of the disconnected connector. The width and length of the protector is selected in accordance with the size of the connector to be covered.

It is therefore a principal object of the invention to provide a protective device for electrical connectors to prevent damage thereto when such connectors are disconnected from their mating connectors.

It is another object of the invention to provide a connector protector having a padded sleeve portion for placing over a cable, the sleeve having closure means along the open edges thereof to permit captivating the sleeve over the cable when the cable is connected, and over the connector when the cable is disconnected.

It is still another object of the invention to provide a connector protector having electrostatic shielding.

It is yet another object of the invention to provide a connector protector having a padded sleeve with hook and loop fastening material along the inner surfaces of the open ends thereof for closing the ends around a cable and the connector.

These and other objects and advantages will become apparent from the following detailed description when read in conjunction with the drawings.

DETAILED DESCRIPTION OF THE PREFERRED EMBODIMENT

Figure 1:
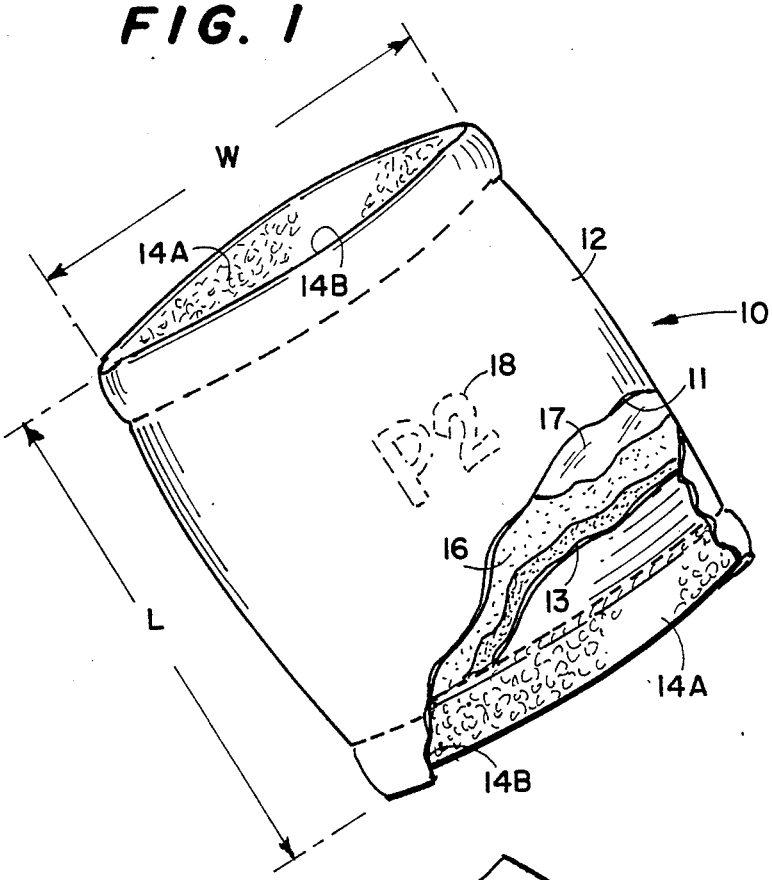
FIG. 1 is a perspective view of a connector protector in accordance with the invention shown partially cut away.

Referring to FIG. 1, a cutaway view of protector 10 is shown. A double-walled sleeve 12 having an outer surface 11 and an inner surface 13 has padding material 16 inserted therebetween. Sleeve 12 is formed from a fabric material, such as a flexible plastic, nylon, cloth or similar material. If desired, an electrostatic shield 17 may be included between padding material 16 and outer surface 11 to prevent any interference from being picked up by open pins of a connector when removed from its mating connector. The width W and the length L of protector 10 is selected in accordance with the size of a connector with which it is used, as will be described below. The open ends of sleeve 12 each have a surface 14A covered with hook fastening material, and an opposing surface 14B covered with loop material. Velcro® is suitable for this purpose. Pressing an open end of 12 together engages the hook and loop materials, thereby closing that end.

Figure 2:
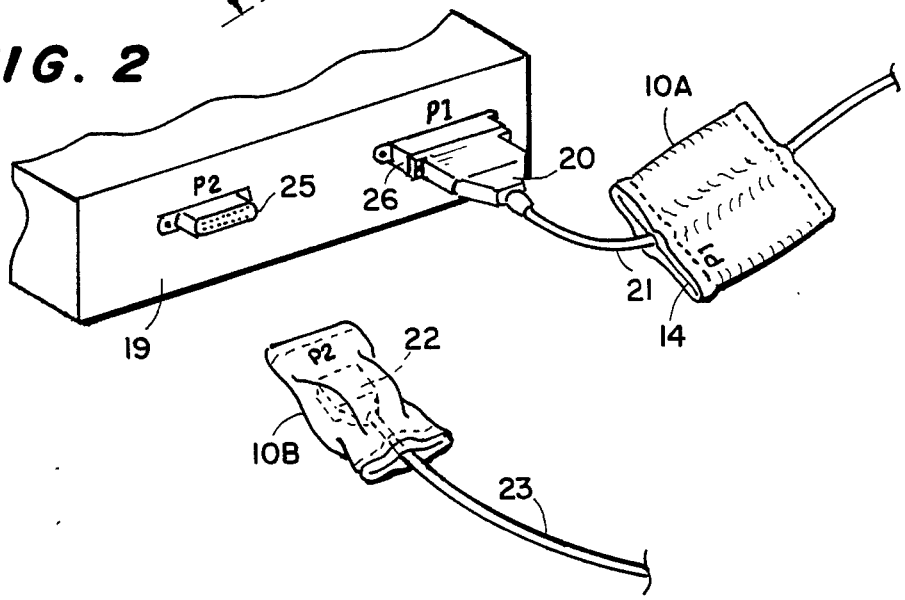
FIG. 2 is a perspective view of a device having cable connectors and cables showing a disconnected cable with a protector of FIG. 1 in place, and a connected cable showing a protector of FIG. 1 captivated along a cable.

The use of protector 10 is illustrated in FIG. 2 showing an electronic device 19 having a chassis connector 26 labeled "P1", and a second chassis connector 25 labeled "P2." A cable connector 20 is indicated connected to chassis connector 26. As will be noted, a protector 10A of FIG. 1 has been placed over cable 21 and the ends thereof closed over cable 21 with hook and loop material 14 holding protector 10A in place along cable 21. Protector 10A is labeled as "P1" by a label 18 seen in FIG. 1.

A cable connector 22 is shown in phantom view, disconnected from its chassis connector 25. Connector 22 has been inserted into protector 10B having a first end of protector 10B closed and the second end thereof closed around cable 23. Thus, connector 22 is protected from damage. If eable 23 is connected to "live" electronic circuits, electrostatic shielding 17 of FIG. 1 will prevent any pickup from stray fields that might otherwise damage such circuits. When cable connector 22 is to be reconnected, the ends of protector 10B are opened and the sleeve is moved a short distance down cable 23 and captivated at that position as shown for cable 21. As will be noted, protectors 10A and 10B have widths and lengths appropriate to the size of connectors 20 and 22 respectively.

It may be seen that the connector protector of the invention is particularly advantageous in installations having a multiplicity of connectors which must be periodically disconnected and reconnected. For example, test benches where equipment is being tested, repaired and calibrated utilize test cables which are continually changed. By identifying the protectors with labels or by color coding, the invention also assists in quickly reconnecting cables to the proper chassis connectors.

Although a specific design for the connector protector has been disclosed for exemplary purposes, various changes in shape, materials, and closures may be made without departing from the scope and spirit of the invention.

I claim:

1. A protector for a cable connector when said connector is disconnected from its mating connector comprising:

a sleeve formed from a flexible fabric having first and second open ends thereof;

padding material covering inside surfaces of said sleeve;

means along the inner edges of said first and second open ends for temporarily closing said open ends wherein said sleeve is to be disposed over a cable having said connector attached at a distal end thereof and said first and second sleeve ends closed around said cable when said connector is attached to a second connector, and, when said connector is disconnected from said second connector, said sleeve encloses said disconnected connector, and said first sleeve end is closed, and said second sleeve end is closed around said cable.

2. The protector as defined in claim 1 in which said closing means includes hook and loop material.

3. The protector as defined in claim 1 in which said sleeve includes a double wall, and said padding material is disposed within said double wall.

4. The protector as defined in claim 1 which further comprises a sheet of electrostatic shielding disposed within said sleeve.

5. The protector as defined in claim 1 in which said sleeve includes means of identification of a connector with which said protector is used.

6. A connector protector for installation on a cable and connector for protecting said connector when temporarily disconnected from its mating connector comprising:

a double walled sleeve formed from a flexible material and having a pair of open ends;

padding material disposed between walls of said double walled sleeve;

opposing strips of hook and loop fastening material attached along inner surfaces of each of said open ends whereby said open ends may be closed by engaging said opposing strips;

whereby said connector is enclosed within said sleeve when disconnected by closing one open end of said sleeve and closing the other open end of said sleeve around said cable.

* * * * *